United States Patent [19]

Strobel

[11] Patent Number: 4,745,646

[45] Date of Patent: May 24, 1988

[54] RAIL CONSTRUCTION FOR HYBRID BED

[76] Inventor: Mark J. Strobel, 3131 Industrial Pkwy., Jeffersonville, Ind. 47130

[21] Appl. No.: 40,344

[22] Filed: Apr. 20, 1987

[51] Int. Cl.[4] ..... A47C 27/08

[52] U.S. Cl. ..... 5/451; 5/460

[58] Field of Search ..... 5/451, 460, 452, 450, 5/400, 401

[56] References Cited

U.S. PATENT DOCUMENTS 3,838,470 10/1974 May ..... 5/460

4,506,397 3/1985 Fogel et al. ..... 5/451

*Primary Examiner*—Alexander Grosz

*Attorney, Agent, or Firm*—James B. Middleton

[57] ABSTRACT

A hybrid mattress has a rail that includes a flexible foam member and a rigid supporting member. The rigid supporting member engages the lower outside of the foam to provide support and prevent bowing. A groove in the outer surface of the foam receives a flange on the inside of the rigid member, and the two mate closely so that mattress coverings can be clamped between the two.

7 Claims, 1 Drawing Sheet

Fig. 1
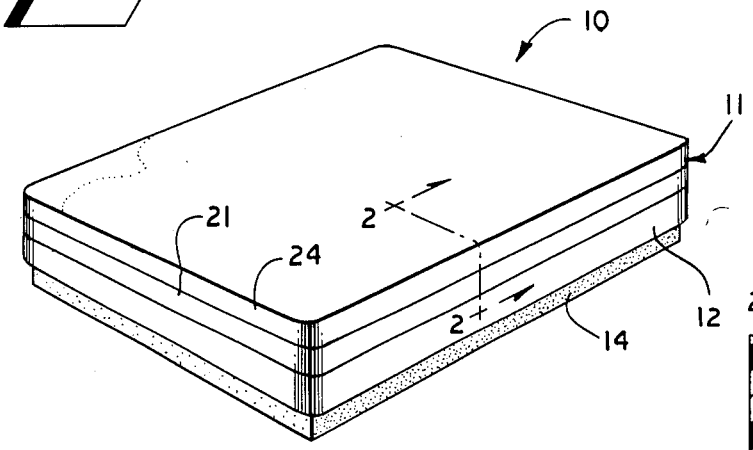
Fig. 3
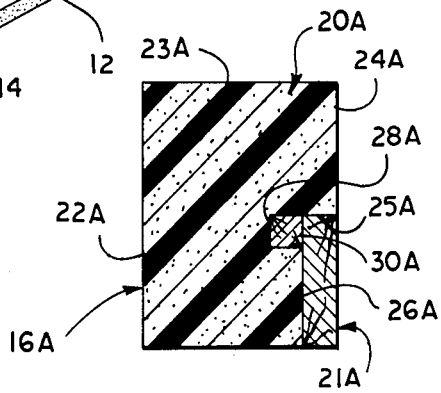
Fig. 2
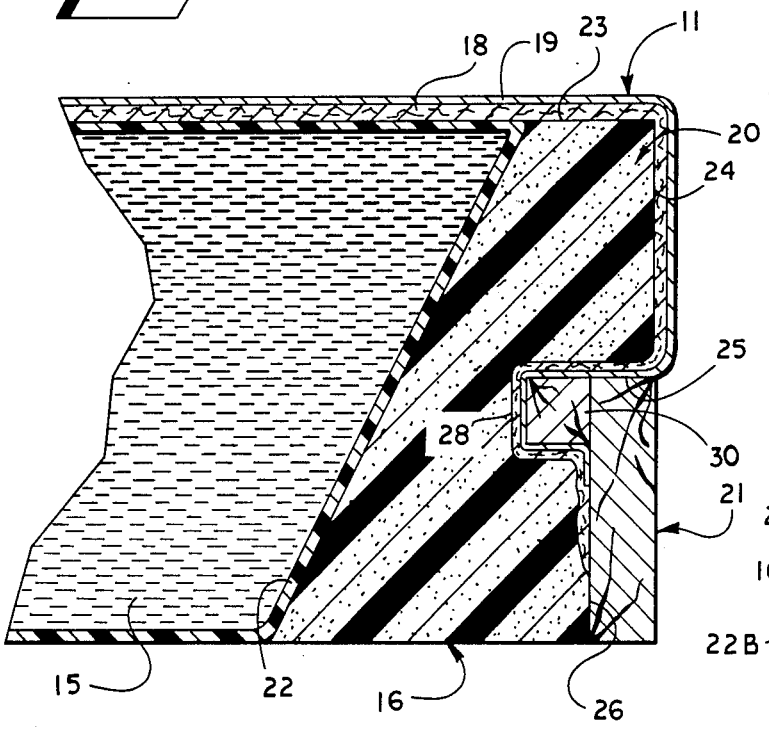
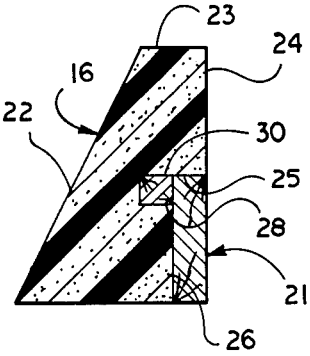
Fig. 4
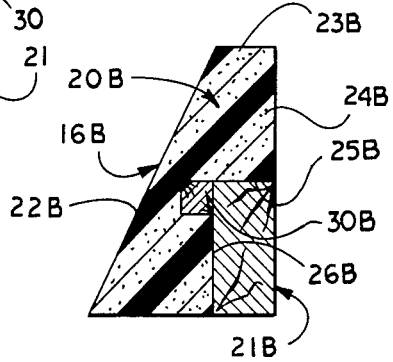
Fig. 5

RAIL CONSTRUCTION FOR HYBRID BED

INFORMATION DISCLOSURE STATEMENT

The hybrid bed is common in the flotation sleep industry, the hybrid being a bed with a water-filled mattress that has the general appearance of an inner-spring mattress. The hybrid bed includes a box-like platform, which is frequently upholstered to resemble box springs. On this platform there is a rail extending the full perimeter of the platform. The rail typically has at least some portion thereof formed of flexible foam, such as polyurethane foam, in conjunction with a relatively rigid member to maintain the shape of the foam rails. Within these rails, a bag is placed, and filled with water to complete the mattress. It is further conventional to place a mattress cover completely around the hybrid mattress, the hybrid mattress including the bag of water and the rails.

The mattress cover for a hybrid mattress most commonly includes a top surface having depending sides extending down the sides of the rails. A bottom surface then extends completely under the hybrid mattress, and extends upwardly to meet the depending edges. The bottom surface is connected to the edges by conventional fastening means, usually a zipper. Alternatively, the mattress cover may include a top panel with depending edges, and inwardly turned bottom flanges. The bottom flanges are then fixed beneath the rails by a hook and teasel fastener.

With the usual arrangement for a mattress cover, it will be readily understood that the cover is not adjustable by the individual user. As a result, a very heavy person, who sinks deeply into the water mattress, will experience a hammocking effect because of the mattress cover.

With hybrid beds, one uses conventional sheets and other coverings for the bed, so the sheets are tucked beneath the foam rail. It will be understood that the rail itself may be rather light in weight, so bed clothing can be easily removed.

Prior art relevant to the present invention includes U.S. Pat. No. 3,838,470, issued to May. This patent does not disclose a hybrid mattress, but discloses a waterbed having rigid rails, the rigid rails having an inwardly directed flange. The May patent contemplates the placing of the sheet between the bag holding the water and the flange extending inwardly from the rail to assist in holding the bedcovers in place.

SUMMARY OF THE INVENTION

This invention relates generally to beds, and is more particularly concerned with a hybrid bed rail construction for holding bed coverings.

The present invention provides a hybrid bed including a rail formed of flexible foam, and a rigid member outwardly of the flexible foam The rigid member includes an inwardly directed flange receivable within a groove in the foam. A mattress cover for use in conjunction with the rail of the present invention includes a top surface and depending side walls. The depending side walls extend inwardly, around the inwardly directed flange of the rigid member to be clamped between flexible foam and the rigid member.

In the preferred embodiment, the groove in the foam is substantially equal to the size of the inwardly directed flange so that insertion of the mattress cover causes some distortion of the foam. With this close fit it will be understood that water pressure from the water-filled bag will cause an increased clamping force around the inwardly directed flange to hold the mattress cover firmly in place. It will be recognized that sheets and other bed coverings can also be placed into the groove of the foam and held by the inwardly directed flange.

BRIEF DESCRIPTION OF THE DRAWINGS

These and other features and advantages of the present invention will become apparent from consideration of the following specification when taken in conjunction with the accompanying drawings in which:

FIG. 1 is a perspective view showing a hybrid bed having a rail made in accordance with the present invention;

FIG. 2 is an enlarged cross-sectional view taken substantially along the line 2—2 in FIG. 1; and, FIGS. 3–5 are cross-sectional views showing modified forms of rails made in accordance with the present invention.

DETAILED DESCRIPTION OF THE EMBODIMENTS

Referring now more particularly to the drawings, and to those embodiments of the invention here presented by way of illustration, FIG. 1 shows a hybrid bed generally indicated at 10 and including a mattress 11 supported on a platform 12. Platform 12 is here shown as mounted on a pedestal 14 though it will be understood that any support means may be utilized, or the platform 12 may be placed directly on the floor.

With attention to FIG. 2 of the drawings, it should be understood that the platform 12 has been omitted so that only the mattress 11 is shown. In FIG. 2, it will be noted that the mattress 11 includes the bag or bladder 15 filled with water, the bladder 15 being within the rail generally designated at 16. The mattress 11 has a mattress cover 18, and a sheet 19 is shown over the mattress cover 18.

Those skilled in the art will understand that the arrangement shown in FIG. 2 is by way of illustration only, and numerous variations will be obvious to those skilled in the art. The mattress cover 18 is here shown as a fibrous material since mattress covers are frequently quilted coverings, though any form of mattress cover may be used if desired. The sheet 19 is shown to illustrate that all bed covering can be held in place by the arrangement disclosed herein. The sheet is by way of example, and additional bed coverings would be held in the same manner.

It will now be seen that the rail 16 includes a flexible foam member 20 and a rigid support 21. The flexible foam 20 includes an upper surface 23 and an inwardly sloped inner wall 22. The outer wall of the foam member 20 comprises a vertical portion 24 which terminates at the upper edge 25 of the rigid member 21.

The lower portion of the foam member 20 has a vertical wall 26 which is inwardly of the wall 24. Between the walls 24 and 26 there is a generally "U" shaped groove 28.

The rigid member 21 is generally rectangular, and has an inwardly directed flange 30 at its upper end. The flange 30 is received within the groove 28 in the foam member 20.

It will now be seen that the mattress cover 18 extends across the surface of the mattress, and extends downwardly to cover the vertical walls 24 of the foam portion 20. The mattress cover 18 then extends inwardly between the upper surface of the rigid member 21 and the foam member 20. The mattress cover 18 should extend completely around the flange 30, and preferably downwardly to some extent on the inside surface of the rigid member 21, adjacent to the vertical wall 26 of the foam member 20. Since the water pressure from the bladder 15 will cause an outward pressure against the inner surface 22 of the foam rail 20, it will be understood that the mattress cover 18 will be urged very tightly against the inwardly directed flange 30 of the rigid member 21.

Since the foam portion 20 is flexible foam, one can very easily deflect the foam to place the mattress cover 18 into the groove 28, and around the flange 30. Similarly, if the mattress cover 18 is too taut, the foam can be deflected and the mattress cover pulled outwardly somewhat to allow more slack in the upper surface. In the same manner, the sheet 19 and other bed coverings may be placed into the groove 28, around the inwardly directed flange 30, and held in place.

The rigid member 21 is here shown as being inset so that the outer surface of the rigid member 21 is co-planar with the surface 24 of the foam portion. It will be understood that such an arrangement is not necessary; but, the rigid member 21 could be outwardly of the foam portion 21, and the surface 24 and 26 of the foam could be co-planar. With this construction, there would still be the groove 28 and the flange 30 as described for holding the mattress coverings 18 and 19.

Attention is next directed to FIG. 3 of the drawings, which shows a modified form of the rail illustrated in FIG. 2. The rail in FIG. 3 is designated at 16A, and the foam portion is designated at 20A while the rigid member is designated at 21A. Other parts carry the same numerals as the rail 16 in FIG. 2 but with an A suffix.

It will therefore be seen that the rail shown in FIG. 3 is generally rectangular in cross-section having the upper surface 23A and upper, outer vertical surface 24A. The rigid member 21A includes an inwardly directed flange 30A which is received within a groove 28A in the foam portion 20A.

FIG. 4 illustrates the rail 16 alone, without the mattress and mattress coverings. Thus, in FIG. 4 it will be seen that the foam 20 and the rigid member 21 are complementary to provide a trapezoidal shape as is common in the industry.

Finally, FIG. 5 is another modification of the rail shown in FIG. 2, and carries the same reference numerals with a B suffix. Again, the rail is shown without the mattress coverings, so the relationship of the foam 20B and the rigid member 21B will be clearly understood.

In FIGS. 2–4 it will be noted that the rigid member 21 is relatively thin. A rigid member such as the member 21 or 21A is conventionally formed of a dressed two-inch board. Because of the constant pressure against the rigid member, a two inch board has been found to be necessary to prevent bowing of the rail. However, with the present invention it has been found that a dressed one-inch board can be used as the rigid member 21, and a one inch flange can be used as the flange 30. Since the force tending to bow the rail is from left to right as viewed in FIGS. 2–4, it will be seen that there is a two inch member to resist the bowing, it being understood that the flange 30 will be rigidly fixed to the member 21 so that the two act as if they were integrally formed.

FIG. 5 of the drawings is the same as FIG. 4 except that the rigid member 21B is formed of a two inch thick board, with the additional one inch flange 30B fixed thereto. Thus, if additional strength is needed, the rigid member 21B can be thicker, and even greater strength is provided by the addition of the flange 30B.

From the foregoing description, it should now be understood that the present invention provides rails for a hybrid bed, the rail including a foam portion having an outwardly facing groove, and a rigid member having an inwardly directed flange for being received within the outwardly facing groove. The groove and flange are urged together by water pressure so mattress coverings extending within the groove are firmly held between the flange 30 and the groove 28.

Because the mattress cover must include only a top surface and a depending portion, there is no requirement for zippers or hook and teasel fastening means, thereby effecting considerable savings in manufacture. It will be understood that a zipper for a mattress cover is around eight yards long, so the zipper is expensive, and the stitching to install the zipper is expensive in labor cost. Similarly, if the mattress cover is to be extended beneath the rail and fixed with a hook and teasel fastener, there is a great length of hook and teasel fastener which is expensive, and installation of the hook portion and the teasel portion is expensive. A further savings can be had because the rigid member 21 of the rail 16 may be thinner material, reinforced with the inwardly directed flange 30 for the needed strength.

The present invention therefore provides an extremely simple and economical means for holding a mattress cover for a hybrid bed, and further provides easy adjustability for the mattress cover. Furthermore, sheets and other mattress coverings can also utilize the same clamping arrangement so the usual bed covering is more secure and has less tendency to slip inadvertently.

It will of course be understood by those skilled in the art that the particular embodiments of the invention here presented are by way of illustration only, and are meant to be in no way restrictive; therefore, numerous changes and modifications may be made, and the full use of equivalents resorted to, without departing from the spirit or scope of the invention as outlined in the appended claims.

I claim:

1. In a hybrid bed comprising a mattress disposed on a supporting surface, and a mattress cover covering said mattress, said mattress including a rail at the perimeter thereof and a flexible bag filled with water within said rail and supported by said rail, said rail including a flexible foam portion for providing a top surface which forms a part of the upper surface, and a rigid portion outwardly of said foam portion for preventing bowing of said rail, the improvement wherein said foam portion comprises an integral member defining an outwardly facing, generally "U" shaped groove, and said rail further includes an inwardly directed flange carried by said rigid portion and disposed within said groove, said groove and said flange being of substantially the same size and shape so that said flange is complementary to said groove, the arrangement being such that said mattress cover passes around said flange and is held thereon by said groove, said bag filled with water serving to increase the holding force between said groove and said flange.

2. In a hybrid bed as claimed in claim 1, the improvement wherein said mattress cover includes at least a mattress cover and a sheet, said mattress cover extending down to cover the side of said rail, and extending into said groove, and terminating between said foam portion and said rigid portion so that said foam secures said mattress cover to said flange.

3. In a hybrid bed as claimed in claim 2, the further improvement wherein the outer surface of said foam portion is co-planar with the outer surface of said rigid portion.

4. In a hybrid bed as claimed in claim 3, the further improvement wherein said rigid portion has insufficient strength to prevent bowing of said rail, and said flange in combination with said rigid portion yields the strength for preventing bowing of said rail.

5. A rail for a hybrid bed, wherein said hybrid bed comprises a water bag and a rail surrounding the water bag for supporting the water bag, the upper surface of the water bag and the rail constituting the sleeping surface for the bed, said rail including a unitary flexible foam portion having an upper surface constituting a part of the sleeping surface, an inner surface for supporting the water bag, and a generally vertical outer surface, said outer surface defining an outwardly facing, generally "U" shaped groove, said rail further including a rigid portion contiguous with a portion of said outer surface of said foam portion, and an inwardly directed flange carried by said rigid portion and disposed within said groove, said groove and said flange being of substantially the same size and shape so that said flange is complementary to said groove, the arrangement being such that mattress coverings are receivable within said groove by distorting said flexible foam, said flexible foam holding said mattress covering to said flange.

6. A rail as claimed in claim 5, said rigid portion having an outer surface co-planar with a portion of the outer surface of said foam portion.

7. A rail as claimed in claim 6, the combination of said flange and said rigid portion providing strength to prevent bowing of said rail.

* * * * *